US012195943B2

(12) United States Patent
Cloud

(10) Patent No.: US 12,195,943 B2
(45) Date of Patent: Jan. 14, 2025

(54) SHOE CONTROL SYSTEM FOR A DOZER BLADE ASSEMBLY

(71) Applicant: CNH Industrial America LLC, New Holland, PA (US)

(72) Inventor: John William Cloud, Winfield, KS (US)

(73) Assignee: CNH Industrial America LLC, New Holland, PA (US)

( * ) Notice: Subject to any disclaimer, the term of this patent is extended or adjusted under 35 U.S.C. 154(b) by 832 days.

(21) Appl. No.: 17/395,609

(22) Filed: Aug. 6, 2021

(65) Prior Publication Data

US 2023/0042695 A1 Feb. 9, 2023

(51) Int. Cl.
*E02F 3/84* (2006.01)

(52) U.S. Cl.
CPC ..... *E02F 3/845* (2013.01); *E02F 3/841* (2013.01)

(58) Field of Classification Search
CPC ..... E02F 3/7618; E02F 3/841; E02F 3/845; E02F 3/847
See application file for complete search history.

(56) References Cited

U.S. PATENT DOCUMENTS 3,770,065 A * 11/1973 Gill ..... E02F 3/841 172/4.5
4,156,466 A * 5/1979 Caldwell ..... E02F 3/841 172/794
4,389,800 A * 6/1983 Goby ..... E02F 3/651 37/415
4,733,355 A 3/1988 Davidson et al.
4,807,375 A 2/1989 Iraci
4,809,487 A * 3/1989 Junge ..... A01D 46/08 56/28
6,202,328 B1 * 3/2001 Fulton ..... E01H 5/068 37/231
6,308,785 B1 * 10/2001 Rhoden ..... A01B 63/22 172/393
6,322,287 B1 * 11/2001 Yelton ..... E01C 19/15 404/98
9,598,829 B2 * 3/2017 Betts ..... E01H 5/098
10,519,615 B2 12/2019 Miller
10,584,464 B2 * 3/2020 Armstrong ..... E02F 3/8157
10,999,965 B2 * 5/2021 Garner ..... A01K 1/01
2010/0326684 A1 * 12/2010 Mullett ..... E02F 3/7618 172/772
2012/0017473 A1 * 1/2012 Paonessa ..... E01H 5/062 37/233
2012/0267128 A1 10/2012 Shintani et al.
2022/0010510 A1 * 1/2022 Bergeron ..... E02F 9/267

* cited by examiner

*Primary Examiner* — Gary S Hartmann
(74) *Attorney, Agent, or Firm* — Rickard K. DeMille; Rebecca L. Henkel; Peter K. Zacharias

(57) ABSTRACT

A shoe control system for a dozer blade assembly includes a controller having a processor and a memory. The controller is configured to determine a direction of travel of the dozer blade assembly. The controller is also configured to control an actuator to drive a shoe of the dozer blade assembly to disengage a ground surface in response to determining the direction of travel is rearward.

20 Claims, 4 Drawing Sheets

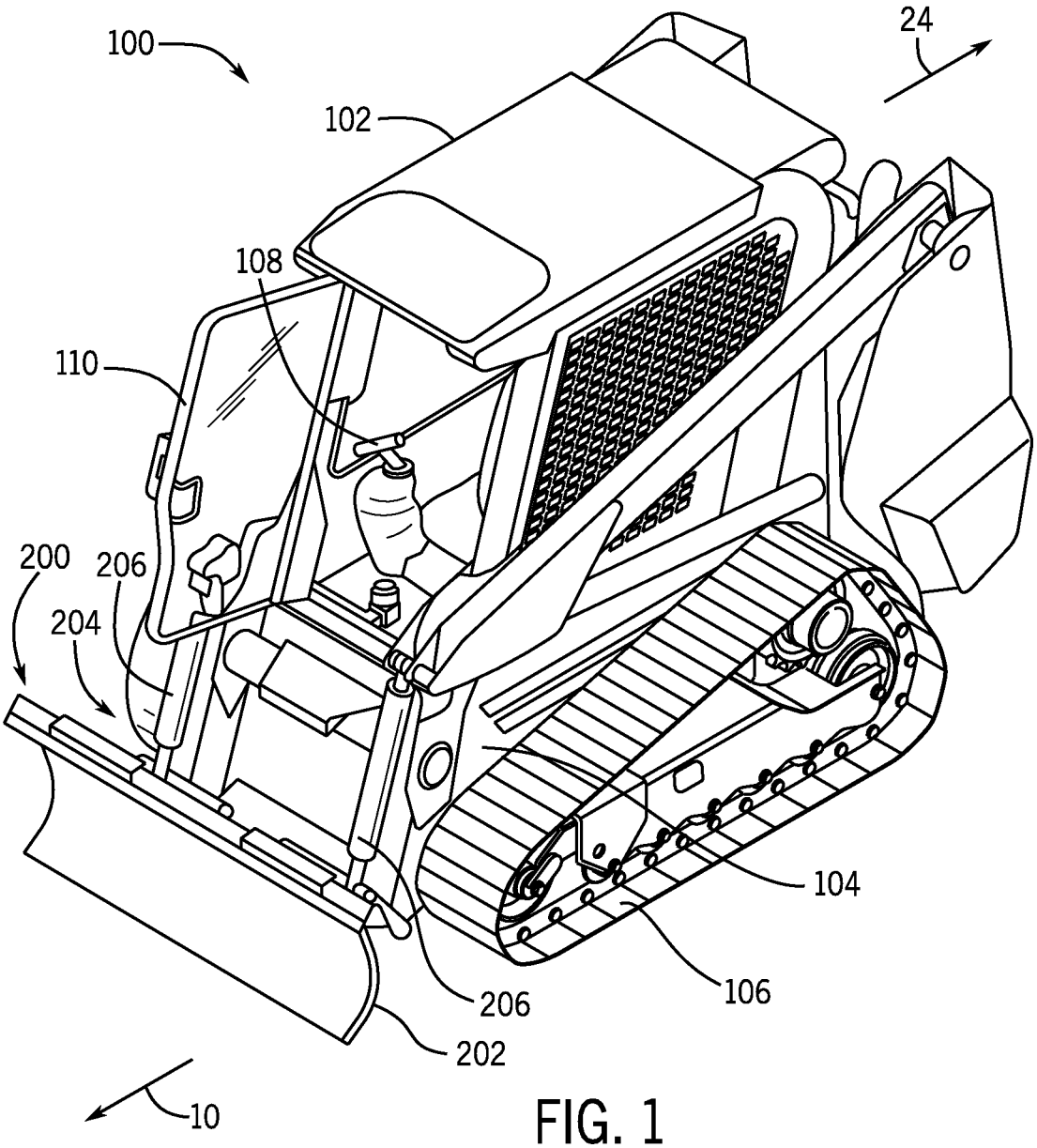
FIG. 1
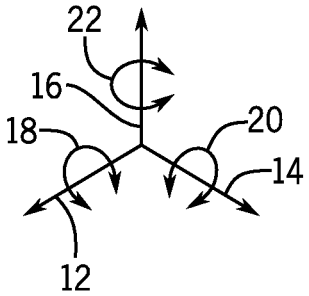

SHOE CONTROL SYSTEM FOR A DOZER BLADE ASSEMBLY

BACKGROUND

The present disclosure relates generally to a shoe control system for a dozer blade assembly.

Certain work vehicles (e.g., tractors, harvesters, skid steers, etc.) are configured to support one or more implements (e.g., a dozer blade, a grapple, etc.). For example, a dozer blade assembly may be coupled to a front portion of a chassis of the work vehicle. The dozer blade assembly includes a dozer blade configured to work ground material (e.g., soil, etc.) within a work area. For example, forward movement of the work vehicle may drive the dozer blade to displace the ground material, and rearward movement of the work vehicle may drive the dozer blade to level the ground material within the work area. Certain dozer blade assemblies include one or more shoes configured to block the dozer blade from digging into the ground material during forward movement of the work vehicle.

BRIEF DESCRIPTION

In certain embodiments, a shoe control system for a dozer blade assembly includes a controller having a processor and a memory. The controller is configured to determine a direction of travel of the dozer blade assembly. The controller is also configured to control an actuator to drive a shoe of the dozer blade assembly to disengage a ground surface in response to determining the direction of travel is rearward.

DRAWINGS

These and other features, aspects, and advantages of the present disclosure will become better understood when the following detailed description is read with reference to the accompanying drawings in which like characters represent like parts throughout the drawings, wherein:

FIG. 1 is a perspective view of an embodiment of a work vehicle and a dozer blade assembly coupled to the work vehicle;

DETAILED DESCRIPTION

Figure 2:
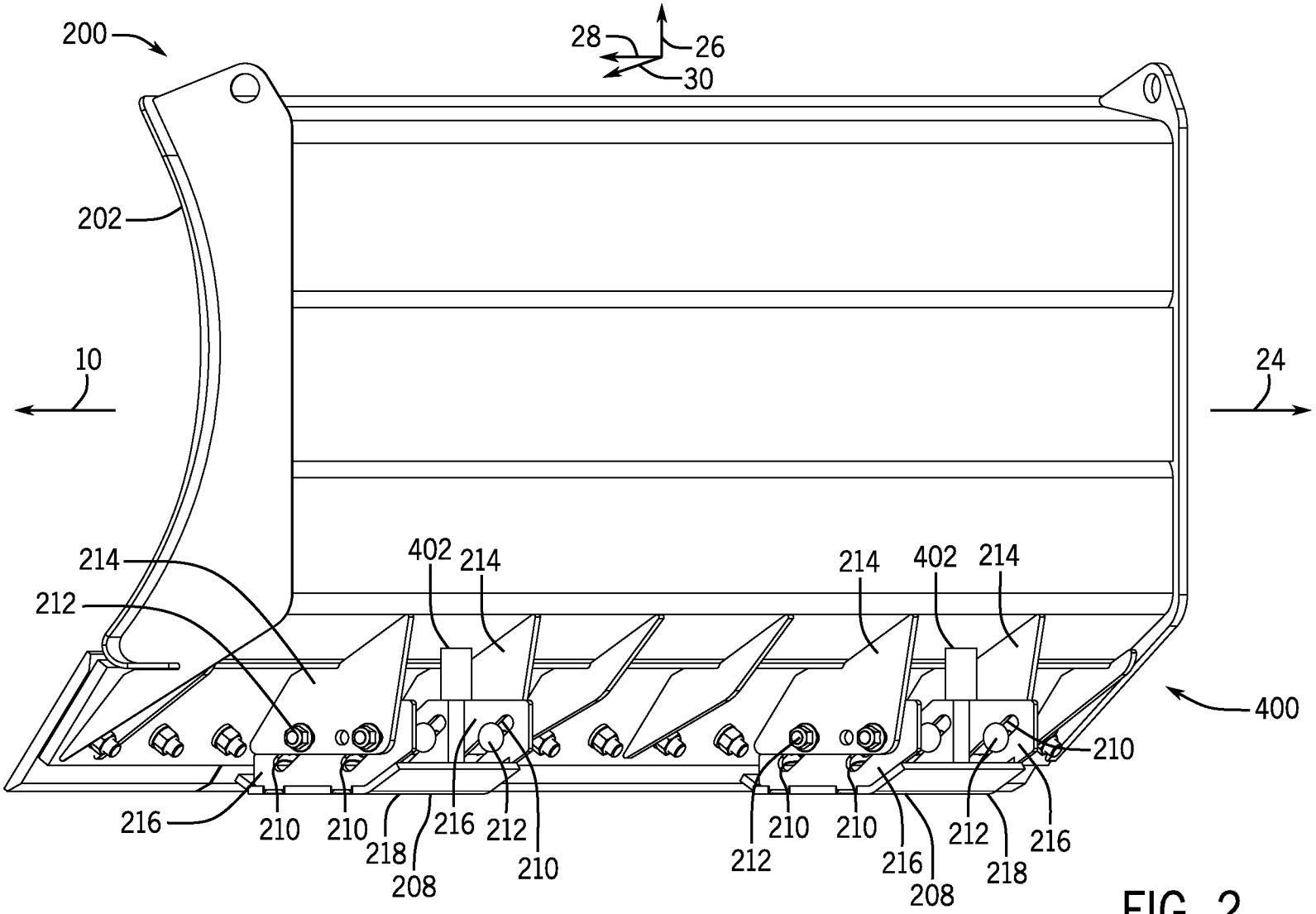
FIG. 2 is a perspective view of an embodiment of a dozer blade assembly that may be employed within the work vehicle of FIG. 1, in which the dozer blade assembly includes shoes.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments.

FIG. 1 is a perspective view of an embodiment of a work vehicle 100 and a dozer blade assembly 200 coupled to the work vehicle 100. In the illustrated embodiment, the work vehicle 100 includes a cab 102 and a chassis 104. In certain embodiments, the chassis 104 is configured to house a motor (e.g., diesel engine, electric motor, etc.), a hydraulic system (e.g., including a pump, valves, a reservoir, etc.), and other components (e.g., an electrical system, a cooling system, etc.) that facilitate operation of the work vehicle. In addition, the chassis 104 is configured to support the cab 102 and tracks 106. The tracks 106 may be driven to rotate by the motor and/or by component(s) of the hydraulic system (e.g., hydraulic motor(s), etc.). While the work vehicle 100 includes tracks 106 in the illustrated embodiment, in other embodiments, the work vehicle may include wheels or a combination of wheels and tracks.

The cab 102 is configured to house an operator of the work vehicle 100. Accordingly, various controls, such as the illustrated hand controller 108, are positioned within the cab 102 to facilitate operator control of the work vehicle 100 and implement(s) coupled to the work vehicle 100, such as the dozer blade assembly 200. For example, the controls may enable the operator to control the rotational speed of the tracks 106, thereby facilitating adjustment of the speed and the direction of the work vehicle 100. In addition, the controls may enable the operator to control the position and/or orientation of the implement(s) coupled to the work vehicle 100. In the illustrated embodiment, the cab 102 includes a door 110 to facilitate ingress and egress of the operator from the cab 102.

In the illustrated embodiment, the dozer blade assembly 200 is coupled to a front portion of the chassis 104. Accordingly, a dozer blade 202 of the dozer blade assembly 200 is positioned forward of the chassis 104 relative to a forward direction of travel 10 of the work vehicle 100/dozer blade assembly 200. As used herein, "dozer blade" refers to any blade configured to engage ground material (e.g., soil, snow, earth, rocks, etc.), including a grader blade and a snow blade. The dozer blade assembly 200 includes an actuator assembly 204 configured to control a position and, in certain embodiments, an orientation of the dozer blade 202 relative to the chassis 104. In the illustrated embodiment, the actuator assembly 204 includes hydraulic cylinders 206 configured to move the dozer blade 202 relative to the chassis 104. In addition, the actuator assembly may include a valve assembly configured to control hydraulic fluid flow to the hydraulic cylinders, thereby controlling the position and, in certain embodiments, the orientation of the dozer blade. In certain embodiments, the actuator assembly 204 may be configured to move the dozer blade 202 along a longitudinal axis 12 of the work vehicle 100, along a lateral axis 14 of the work vehicle 100, along a vertical axis 16 of the work vehicle 100, or a combination thereof. In addition, the actuator assembly 204 may be configured to rotate the dozer blade 202 about the longitudinal axis 12 in roll 18, about the lateral axis 14 in pitch 20, about the vertical axis 16 in yaw 22, or a combination thereof. While the actuator assembly includes hydraulic cylinders in the illustrated embodiment, in other embodiments, the actuator assembly may include other suitable actuator(s) (e.g., alone or in combination with the hydraulic cylinders), such as hydraulic motor(s), pneumatic actuator(s), electromechanical actuator(s), other suitable type(s) of actuator(s), or a combination thereof.

In certain embodiments, the dozer blade assembly 200 includes one or more shoes configured to block the dozer blade 202 from digging into ground material (e.g., soil, etc.) during movement of the work vehicle 100/dozer blade assembly 200 in the forward direction of travel 10. For example, during a leveling operation, movement of the work vehicle 100 in the forward direction of travel 10 may drive the dozer blade 202 to displace the ground material, and the shoe(s) may at least partially control the penetration depth of the dozer blade 202 into the ground material. As discussed in detail below, a shoe control system for the dozer blade assembly 200 may be utilized to control the position of the shoe(s) relative to the dozer blade 202. The shoe control system may include a controller configured to determine a direction of travel of the dozer blade assembly 200 (e.g., in the forward direction of travel 10 or in a rearward direction of travel 24). For example, the controller may be configured to receive an input signal indicative of the direction of travel (e.g., from the hand controller 108, from a spatial locating device, from a speed sensor, from a user interface, etc.) and to determine the direction of travel based on the input signal. In addition, the controller may be configured to control actuator(s) to drive the shoe(s) of the dozer blade assembly 200 to disengage a ground surface in response to determining the direction of travel is rearward. Accordingly, as the work vehicle 100 drives the dozer blade 202 in the rearward direction of travel 24 to level the ground material, the shoe(s) are disengaged from the ground surface. As a result, the possibility of the shoe(s) forming respective indentation(s) in the ground surface during the rearward movement of the dozer blade is substantially reduced or eliminated, thereby enhancing the effectiveness of the leveling operation. In the illustrated embodiment, the work vehicle 100 is a skid steer. However, the shoe control system disclosed herein may be utilized for a dozer blade assembly coupled to any other suitable work vehicle, such as a tractor, a dozer, a snow plow, or other suitable vehicle.

FIG. 2 is a perspective view of an embodiment of a dozer blade assembly 200 that may be employed within the work vehicle of FIG. 1, in which the dozer blade assembly 200 includes shoes 208. Each shoe 208 is movably coupled to the dozer blade 202 and configured to move relative to the dozer blade 202 (e.g., along a local vertical axis 26 of the dozer blade assembly 200). In the illustrated embodiment, each shoe 208 includes slots 210, and a fastener 212 (e.g., bolt, screw, rivet, etc.) extends through each slot 210. Each fastener 212 is non-movably coupled to a mount 214, and each mount 214 is non-movably coupled to the dozer blade 202 (e.g., by a welded connection, by an adhesive connection, by fastener(s), etc.). Accordingly, the slots 210 enable movement of each shoe 208 relative to the dozer blade 202. In the illustrated embodiment, each slot 210 is angled with respect to the local vertical axis 26 of the dozer blade assembly 200. Accordingly, each shoe 208 may move along the local vertical axis 26 and along a local longitudinal axis 28 of the dozer blade assembly 200. However, in other embodiments, the slots of at least one shoe may be substantially aligned with the local vertical axis 26 of the dozer blade assembly 200.

While each shoe 208 is supported by two mounts 214 in the illustrated embodiment, in other embodiments, at least one shoe may be supported by more or fewer mounts (e.g., 1, 3, 4, or more). Furthermore, while each shoe 208 includes four slots 210 in the illustrated embodiment, in other embodiments, at least one shoe may include more or fewer slots (e.g., 1, 2, 3, 5, 6, or more). In addition, while the slots 210 are formed in the shoes 208 in the illustrated embodiment, in other embodiments, at least one slot may be formed within a respective mount. In such embodiments, the fastener(s) extending through the slot(s) in the mount(s) may be non-movably coupled to the respective shoe(s) and/or disposed through respective slot(s) in the respective shoe(s). Furthermore, while each shoe 208 is movably coupled to the dozer blade by a pin/slot assembly in the illustrated embodiment, in other embodiments, at least one shoe may be movably coupled to the dozer blade by other suitable assembly/assemblies (e.g., alone or in combination with the pin/slot assembly), such as track assembly/assemblies, tongue and groove assembly/assemblies, other suitable type(s) of assembly/assemblies, or a combination thereof.

In the illustrated embodiment, each shoe 208 includes a pair of sidewalls 216 configured to contact the respective mounts 214, thereby substantially blocking movement of the shoe 208 relative to the dozer blade 202 along a local lateral axis 30 of the dozer blade assembly 200. However, in other embodiments, at least one shoe may include other suitable feature(s) (e.g., alone or in combination with the side walls) configured to substantially block lateral movement of the shoe relative to the dozer blade, such as stop(s), tongue and groove assembly/assemblies, other suitable type(s) of assembly/assemblies, or a combination thereof. Furthermore, each shoe 208 includes a contact pad 218 configured to engage the ground surface. The contact pads 218 may have any suitable shape to enable the shoes 208 to move along the ground surface and to block the dozer blade 202 from digging into the ground material during movement of the dozer blade assembly 200 in the forward direction of travel 10. While the dozer blade assembly 200 includes two shoes 208 in the illustrated embodiment, in other embodiments, the dozer blade assembly may have any suitable number of shoes (e.g., 1, 3, 4, 5, 6, or more).

As discussed in detail below, a shoe control system 400 for the dozer blade assembly 200 may be utilized to control the position of the shoes 208 relative to the dozer blade 202. In the illustrated embodiment, the shoe control system 400 includes actuators 402, and each actuator 402 is configured to couple to a respective shoe 208 of the dozer blade assembly 200. In addition, each actuator 402 is configured to drive the respective shoe 208 to move relative to the dozer blade 202 along the local vertical axis 26. The actuators 402 are communicatively coupled to a controller of the shoe control system. The controller is configured to determine a direction of travel of the dozer blade assembly 200, and the controller is configured to control the actuators to drive the respective shoes to disengage the ground surface in response to determining the direction of travel is rearward. Accordingly, as the dozer blade 202 moves in the rearward direction of travel 24 to level the ground material, the shoes are disengaged from the ground surface. As a result, the possibility of the shoes forming respective indentations in the ground surface during the rearward movement of the dozer blade is substantially reduced or eliminated, thereby enhancing the effectiveness of the leveling operation.

While the shoe control system 400 includes two actuators 402 in the illustrated embodiment, in other embodiments, the shoe control system may include more or fewer actuators. For example, in certain embodiments, the shoe control system may include one actuator for each respective shoe. Furthermore, in certain embodiments, multiple actuators may be coupled to one shoe, and/or a single actuator may be coupled to multiple shoes (e.g., via a linkage assembly, etc.). As discussed in detail below, each actuator may include a hydraulic actuator, an electromechanical actuator, or another suitable type of actuator.

Figure 3:
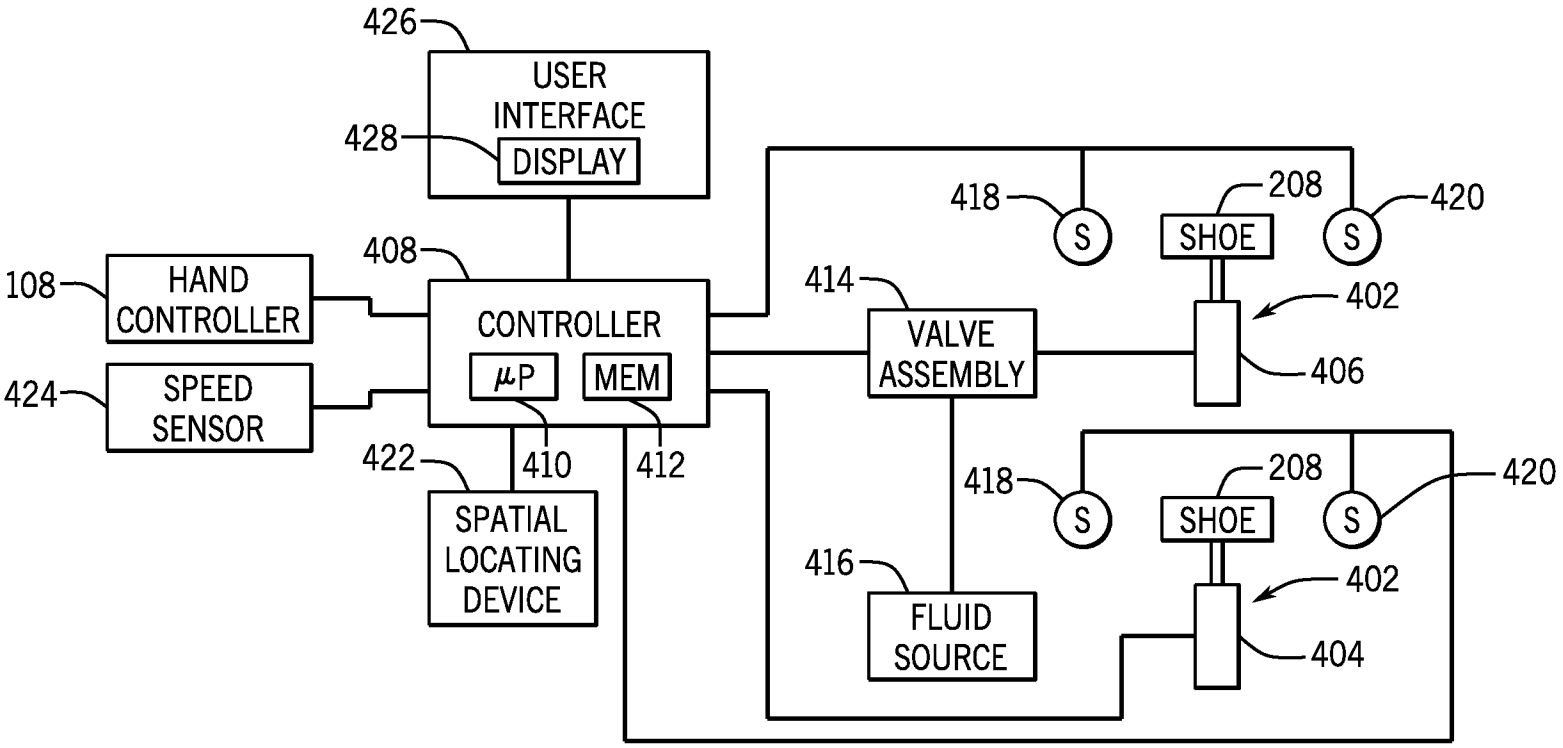
FIG. 3 is a block diagram of an embodiment of a shoe control system that may be utilized to control the shoes of the dozer blade assembly of FIG. 2.

FIG. 3 is a block diagram of an embodiment of a shoe control system 400 that may be utilized to control the shoes 208 of the dozer blade assembly of FIG. 2. As previously discussed, the shoe control system 400 includes actuators 402 configured to drive the shoes 208 to move relative to the dozer blade. In the illustrated embodiment, a first actuator 402 includes an electromechanical actuator 404 (e.g., electric screw drive, electric linear actuator, electric motor, etc.), and a second actuator 402 includes a hydraulic actuator 406 (e.g., hydraulic cylinder, hydraulic motor, etc.).

In the illustrated embodiment, the shoe control system 400 includes a controller 408 communicatively coupled to the actuators 402. In certain embodiments, the controller 408 is coupled to the work vehicle (e.g., disposed within a cab of the work vehicle, coupled to an exterior surface of the work vehicle, positioned within an engine compartment of the work vehicle, etc.), positioned remote from the work vehicle (e.g., at a base station, within a handheld device, etc.), or distributed between multiple locations (e.g., a portion of the controller may be coupled to the work vehicle and another portion of the controller may be positioned remote from the work vehicle). The controller 408 is configured to control the actuators 402, thereby moving the shoes 208 relative to the dozer blade. In certain embodiments, the controller 408 is an electronic controller having electrical circuitry configured to control the actuators 402. In the illustrated embodiment, the controller 408 includes a processor, such as the illustrated microprocessor 410, and a memory device 412. The controller 408 may also include one or more storage devices and/or other suitable component(s). The processor 410 may be used to execute software, such as software for controlling the actuators 402, and so forth. Moreover, the processor 410 may include multiple microprocessors, one or more "general-purpose" microprocessors, one or more special-purpose microprocessors, and/or one or more application specific integrated circuits (ASICs), or some combination thereof. For example, the processor 410 may include one or more reduced instruction set (RISC) processors.

The memory device 412 may include a volatile memory, such as random access memory (RAM), and/or a nonvolatile memory, such as read-only memory (ROM). The memory device 412 may store a variety of information and may be used for various purposes. For example, the memory device 412 may store processor-executable instructions (e.g., firmware or software) for the processor 410 to execute, such as instructions for controlling the actuators 402, and so forth. The storage device(s) (e.g., nonvolatile storage) may include ROM, flash memory, a hard drive, or any other suitable optical, magnetic, or solid-state storage medium, or a combination thereof. The storage device(s) may store data, instructions (e.g., software or firmware for controlling the actuators 402, etc.), and any other suitable data.

As illustrated, the electromechanical actuator 404 is directly communicatively coupled to the controller 408. In addition, the hydraulic actuator 406 is communicatively coupled to the controller 408 via a valve assembly 414 of the shoe control system 400. As illustrated, the valve assembly 414 is communicatively coupled to the controller 408, and the valve assembly 414 is fluidly coupled to the hydraulic actuator 406. The valve assembly 414 may include one or more valves configured to control flow of fluid from a fluid source 416 to the hydraulic actuator 406 and to control flow of fluid from the hydraulic actuator 406 to a drain. For example, in certain embodiments, to drive the respective shoe 208 toward the ground surface, the valve assembly 414 may enable fluid to flow from the fluid source 416 to a cap end of the hydraulic actuator 406, and the valve assembly 414 may enable fluid to flow from the rod end of the hydraulic actuator 406 to the drain. In addition, to drive the respective shoe 208 away from the ground surface, the valve assembly 414 may enable fluid to flow from the fluid source 416 to the rod end of the hydraulic actuator 406, and the valve assembly 414 may enable fluid to flow from the cap end of the hydraulic actuator 406 to the drain. In other embodiments, to drive the respective shoe 208 toward the ground surface, the valve assembly 414 may enable fluid to flow from the fluid source 416 to a rod end of the hydraulic actuator 406, and the valve assembly 414 may enable fluid to flow from the cap end of the hydraulic actuator 406 to the drain. In addition, to drive the respective shoe 208 away from the ground surface, the valve assembly 414 may enable fluid to flow from the fluid source 416 to the cap end of the hydraulic actuator 406, and the valve assembly 414 may enable fluid to flow from the rod end of the hydraulic actuator 406 to the drain.

While the shoe control system 400 includes an electromechanical actuator 404 and a hydraulic actuator 406 in the illustrated embodiment, in other embodiments, the shoe control system may include different type(s) of actuator(s). For example, in certain embodiments, each actuator of the shoe control system may include an electromechanical actuator, or each actuator of the shoe control system may include a hydraulic actuator. Furthermore, in certain embodiments, at least one actuator of the shoe control system may include a pneumatic actuator (e.g., pneumatic cylinder, pneumatic motor, air bag(s), etc.), and/or at least one actuator of the shoe control system may include another suitable type of actuator. For example, in certain embodiments, each actuator of the shoe control system may include a pneumatic actuator. In embodiments including at least one pneumatic actuator, the pneumatic actuator(s) may be fluidly coupled to the valve assembly, and the valve assembly may include one or more valves configured to control airflow from an air source to the pneumatic actuator(s).

The controller 408 is configured to determine a direction of travel of the dozer blade assembly. In the illustrated embodiment, the controller 408 is configured to receive an input signal indicative of a direction of travel of the dozer blade assembly, and the controller 408 is configured to determine the direction of travel based on the input signal. In addition, the controller 408 is configured to control the actuators 402 to drive the respective shoes 208 to disengage the ground surface in response to determining the direction of travel is rearward. Accordingly, as the work vehicle drives the dozer blade in the rearward direction of travel to level the ground material, the shoes are disengaged from the ground surface. As a result, the possibility of the shoes forming respective indentations in the ground surface during the rearward movement of the dozer blade is substantially reduced or eliminated, thereby enhancing the effectiveness of the leveling operation.

Furthermore, in certain embodiments, the controller 408 is configured to control the actuators 402 to drive the respective shoes 208 to engage the ground surface in response to determining the direction of travel is forward. As a result, the shoes 208 may engage the ground surface to block the dozer blade from digging into the ground material during forward movement of the work vehicle. In certain embodiments, the controller 408, in response to determining the direction of travel is rearward, is configured to store (e.g., in the memory 412 of the controller 408) an initial position of each shoe 208 relative to the dozer blade before controlling the respective actuator to drive the shoe 208 to disengage the ground surface. In addition, the controller 408 is configured to control each actuator 402 to drive the respective shoe 208 to move to the respective initial position in response to determining the direction of travel is forward.

Furthermore, in certain embodiments, the dozer blade assembly may include upper stop(s) and/or lower stop(s) configured to establish a range of motion of one or more shoes. For example, upper stop(s) may be positioned above one or more shoes and configured to block movement of the shoe(s) away from the ground surface. Accordingly, in response to determining the direction of travel is rearward, the controller may control the respective actuator(s) to drive the shoe(s) away from the ground surface until the shoe(s) contact the upper stop(s). Additionally or alternatively, lower stop(s) may be positioned below one or more shoe(s) and configured to block movement of the shoe(s) toward the ground surface. Accordingly, in response to determining the direction of travel is forward, the controller may control the respective actuator(s) to drive the shoe(s) toward the ground surface until the shoe(s) contact the lower stop(s). In certain embodiments, the position(s) of the upper stop(s) relative to the dozer blade (e.g., along the local vertical axis of the dozer blade assembly) may be adjustable (e.g., by moving the stop(s) between apertures, by sliding the stop(s) along track(s), by moving the stop(s) along slot(s), etc.), and/or the position(s) of the lower stop(s) relative to the dozer blade (e.g., along the local vertical axis of the dozer blade assembly) may be adjustable (e.g., by moving the stop(s) between apertures, by sliding the stop(s) along track(s), by moving the stop(s) along slot(s), etc.). Furthermore, in certain embodiments, at least one stop may be fixed to the dozer blade/respective mount. Each stop may include any suitable device configured to block movement of the respective shoe (e.g., a pin, a protrusion, a rod, a bar, etc.). While stops are disclosed above, in certain embodiments, the dozer blade assembly may not include any stops for the shoes.

In the illustrated embodiment, the shoe control system 400 includes shoe position sensors 418, and each shoe position sensor 418 is configured to output a sensor signal indicative of the position of the respective shoe relative to the dozer blade. Accordingly, the controller 408 may determine the initial position of each shoe 208 based on feedback from the respective shoe position sensor 418, and the controller 408 may control each actuator 402 to drive the respective shoe 208 to move to the initial position based on feedback from the respective shoe position sensor 418. The shoe position sensors 418 may include any suitable type(s) of sensors configured to monitor the positions of the shoes 208 relative to the dozer blade, such as potentiometer(s), optical sensor(s), infrared sensor(s), ultrasonic sensor(s), linear variable differential transformer(s) (LVDT), capacitance sensor(s), inductive sensor(s), other suitable type(s) of sensor(s), or a combination thereof. Furthermore, in certain embodiments, the shoe control system may include one or more shoe positions sensors for each shoe. While the shoe control system 400 includes shoe position sensors 418 in the illustrated embodiment, in other embodiments (e.g., in embodiments in which the initial position is not stored), the shoe position sensors may be omitted.

Furthermore, in the illustrated embodiment, the shoe control system 400 includes ground contact sensors 420 communicatively coupled to the controller 408. Each ground contact sensor 420 is configured to output a sensor signal indicative of contact between the respective shoe 208 and the ground surface. In certain embodiments, the controller 408, in response to determining the direction of travel is rearward, is configured to control each actuator 402 to drive the respective shoe 208 away from the ground surface at least until contact between the shoe 208 and the ground surface is terminated. For example, in certain embodiments, the controller 408 may control each actuator 402 to drive the respective shoe 208 away from the ground surface until contact between the shoe 208 and the ground surface is terminated. In other embodiments, the controller 408 may control each actuator 402 to drive the respective shoe 208 (e.g., upwardly) away from the ground surface a selected distance (e.g., 1 cm, 2 cm, 3 cm, 4 cm, 5 cm, 6 cm, 7 cm, 8 cm, etc.) above the location at which contact between the shoe 208 and the ground surface is terminated (e.g., based on feedback from the respective shoe position sensor). Furthermore, in certain embodiments, the controller 408, in response to determining the direction of travel is forward, is configured to control each actuator 402 to drive the respective shoe 208 toward the ground surface at least until contact between the shoe 208 and the ground surface is established. For example, in certain embodiments, the controller 408 may control each actuator 402 to drive the respective shoe 208 toward the ground surface until contact between the shoe 208 and the ground surface is established. In other embodiments, the controller 408 may control each actuator 402 to drive the respective shoe 208 (e.g., downwardly) a selected distance (e.g., 1 cm, 2 cm, 3 cm, 4 cm, 5 cm, 6 cm, 7 cm, 8 cm, etc.) beyond the location at which contact between the shoe 208 and the ground surface is established (e.g., based on feedback from the respective shoe position sensor). The ground contact sensors 420 may include any suitable type(s) of sensors configured to monitor contact between the shoes and the ground surface, such as optical sensor(s), infrared sensor(s), ultrasonic sensor(s), capacitance sensor(s), contact switch(es), pressure sensor(s), load cell(s), strain gauge(s), other suitable type(s) of sensor(s), or a combination thereof. Furthermore, in certain embodiments, the shoe control system may include one or more ground contact sensors for each shoe.

While the shoe control system 400 includes ground contact sensors 420 in the illustrated embodiment, in other embodiments, the ground contact sensors may be omitted. For example, in certain embodiments, the controller 408, in response to determining the direction of travel is rearward, may control the actuators 402 to drive the shoes 208 to move a selected distance upwardly along the local vertical axis of the dozer blade assembly (e.g., 1 cm, 2 cm, 3 cm, 4 cm, 5 cm, 6 cm, 7 cm, 8 cm, etc.) with respect to the dozer blade (e.g., based on feedback from the respective shoe position sensors), such that the shoes 208 disengage the ground surface. Furthermore, the controller 408, in response to determining the direction of travel is forward, may control the actuators 402 to drive the shoes 208 to move a selected distance downwardly along the local vertical axis of the dozer blade assembly (e.g., 1 cm, 2 cm, 3 cm, 4 cm, 5 cm, 6 cm, 7 cm, 8 cm, etc.) with respect to the dozer blade (e.g., based on feed back from the respective shoe position sensors). As a result, the shoes 208 may engage the ground surface. For example, the selected downward distance may be equal to the selected upward distance.

In the illustrated embodiment, the shoe control system 400 includes the hand controller 108, which is configured to control the direction of travel of the work vehicle. As illustrated, the hand controller 108 is communicatively coupled to the controller 408, and the hand controller 108 is configured to output the input signal indicative of the direction of travel of the work vehicle/dozer blade assembly to the controller 408. The controller 408 is configured to determine whether the work vehicle/dozer blade assembly is moving in the forward or rearward direction based on the input signal from the hand controller 108.

In the illustrated embodiment, the shoe control system 400 includes a spatial locating device 422, which may be mounted to the work vehicle or the dozer blade assembly. The spatial locating device 422 is configured to monitor a position and a velocity of the work vehicle/dozer blade assembly. The spatial locating device may include any suitable system configured to monitor the position and velocity of the work vehicle/dozer blade, such as a global positioning system (GPS), for example. In certain embodiments, the spatial locating device 422 may be configured to monitor the position and velocity of the work vehicle/dozer blade assembly relative to a fixed point within a work area (e.g., via a fixed radio transceiver). Accordingly, the spatial locating device 422 may be configured to monitor the position and velocity of the work vehicle/dozer blade assembly relative to a fixed global coordinate system (e.g., via the GPS) or a fixed local coordinate system. In the illustrated embodiment, the spatial locating device 422 is communicatively coupled to the controller 408, and the spatial locating device 422 is configured to output the input signal indicative of the direction of travel of the work vehicle/dozer blade assembly (e.g., indicative of the velocity of the work vehicle/dozer blade assembly) to the controller 408. The controller 408 is configured to determine whether the work vehicle/dozer blade assembly is moving in the forward or rearward direction based on the input signal from the spatial locating device 422.

In the illustrated embodiment, the shoe control system 400 includes a speed sensor 424 communicatively coupled to the controller 408. The speed sensor 424 is configured to output the input signal indicative of the direction of travel of the work vehicle/dozer blade assembly (e.g., indicative of the speed and direction of travel of the work vehicle/dozer blade assembly) to the controller 408. The controller 408 is configured to determine whether the work vehicle/dozer blade assembly is moving in the forward or rearward direction based on the input signal from the speed sensor 424. The speed sensor 424 may include any suitable sensor(s) configured to monitor the speed and direction of travel of the work vehicle/dozer blade assembly, such as a rotation sensor coupled to a rotating component of the transmission, a rotation sensor coupled to a wheel/track of the work vehicle, an optical sensor directed toward the ground surface, other suitable type(s) of sensor(s), or a combination thereof.

In the illustrated embodiment, the shoe control system 400 includes a user interface 426 communicatively coupled to the controller 408. The user interface 426 is configured to receive input from an operator and to provide information to the operator. The user interface 426 may include any suitable input device(s) for receiving input, such as a keyboard, a mouse, button(s), switch(es), knob(s), other suitable input device(s), or a combination thereof. In addition, the user interface 426 may include any suitable output device(s) for presenting information to the operator, such as a speaker, indicator light(s), other suitable output device(s), or a combination thereof. In the illustrated embodiment, the user interface 426 includes a display 428 configured to present visual information to the operator. In certain embodiments, the display 428 may include a touchscreen interface configured to receive input from the operator. In certain embodiments, the user interface 426 is configured to output the input signal indicative of the direction of travel of the work vehicle/dozer blade assembly to the controller 408 in response to operator input to the user interface 426 (e.g., in embodiments in which operation of the work vehicle/dozer blade assembly is at least partially controlled via the user interface). The controller 408 is configured to determine whether the work vehicle/dozer blade assembly is moving in the forward or rearward direction based on the input signal from the user interface 426. Furthermore, in certain embodiments, the user interface 426 may be configured to receive additional operator inputs related to control of the shoes, such as the initial position, the selected distance away from the ground surface, the selected distance beyond the location at which contact between each shoe and the ground surface is established, another suitable parameter(s), or a combination thereof.

While the controller 408 is configured to determine the direction of travel of the work vehicle/dozer blade assembly based on feedback from the user interface 426, the hand controller 108, the speed sensor 424, and the spatial locating device 422 in the illustrated embodiment, in other embodiments, the controller may be configured to determine the direction of travel based on a portion of the devices disclosed above (e.g., based on a single device disclosed above, etc.). Furthermore, in certain embodiments, the controller may be configured to determine the direction of travel based on feedback from other suitable device(s) (e.g., alone or in combination with any or all of the devices disclosed above), such as a fixed ground-based sensor within the work area, a remote device, other suitable type(s) of device(s), or a combination thereof.

In addition, in certain embodiments, the controller may be configured to determine the direction of travel based on other information (e.g., alone or in combination with the input signal(s) from the device(s)). For example, in certain embodiments, the work vehicle may be autonomous or semi-autonomous. In such embodiments, a plan may be stored with in the controller 408 (e.g., within the memory 412 of the controller), and the plan may include a route of the work vehicle through the work area. The route may include one or more portions in which the work vehicle moves in the forward direction of travel and one or more portions in which the work vehicle moves in the rearward direction of travel. Accordingly, the controller 408 may be configured to determine the direction of travel of the work vehicle/dozer blade assembly based on the plan stored within the controller 408. In certain embodiments, the plan may include a delay between forward and rearward movement to enable the controller to control the actuators to drive the shoes to disengage the ground surface before rearward movement is initiated. In such embodiments, the controller may determine the direction of travel is rearward at the initiation of the delay.

Figure 4:
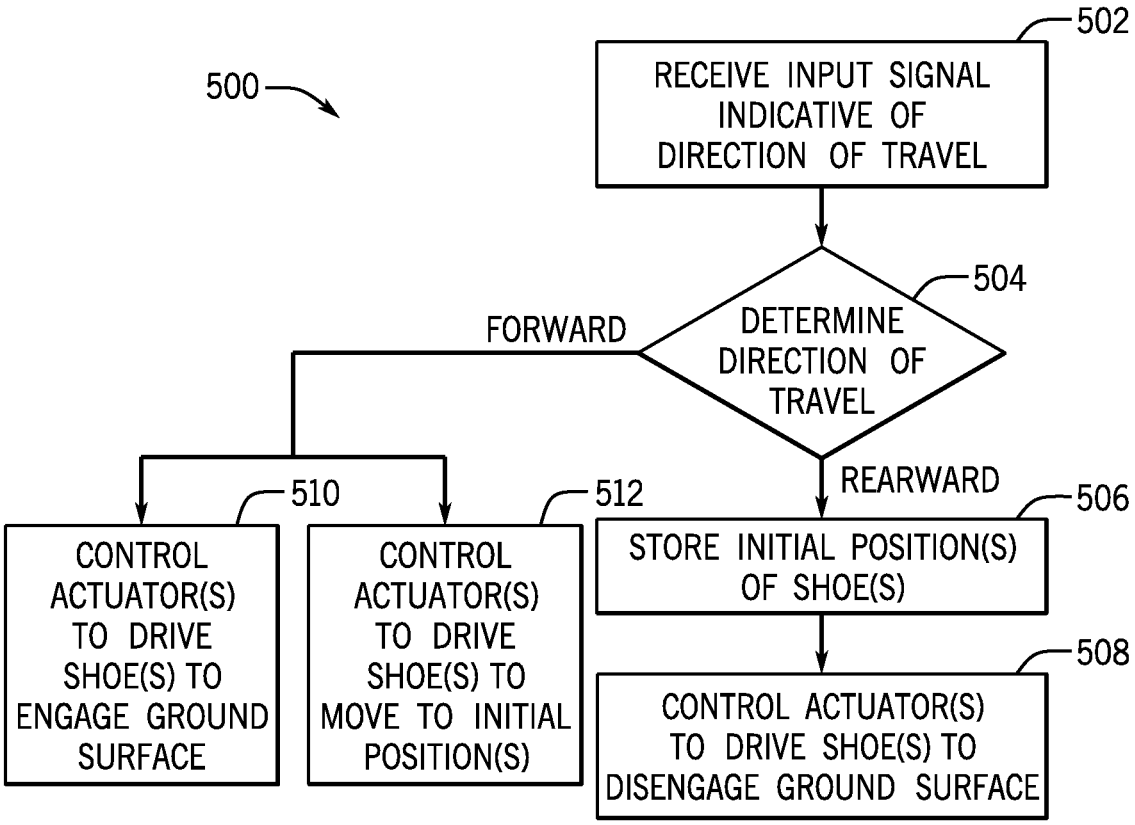
FIG. 4 is a flow diagram of an embodiment of a method for controlling a shoe of a dozer blade assembly.

FIG. 4 is a flow diagram of an embodiment of a method 500 for controlling a shoe of a dozer blade assembly. The method 500 may be performed by the controller disclosed above with referenced to FIG. 3 or any other suitable controller(s). Furthermore, the steps of the method 500 may be performed in the order disclosed herein or in any other suitable order. In addition, in certain embodiments, at least one of the steps of the method 500 may be omitted.

As represented by block 502, an input signal indicative of the direction of travel is received. In certain embodiments, the input signal may be received from a spatial locating device configured to monitor the position and the velocity of the work vehicle/dozer blade assembly. Furthermore, in certain embodiments, the input signal may be received from a hand controller configured to control the direction of travel of the work vehicle. In addition, in certain embodiments, the input signal may be received from a speed sensor configured to monitor the speed and the direction of travel of the work vehicle/dozer blade assembly. Furthermore, in certain embodiments, the input signal may be received from a user interface configured to receive operator input indicative of the direction of travel.

Next, as represented by block 504, the direction of travel of the dozer blade assembly is determined. In certain embodiments, the direction of travel may be determined based on the input signal. Furthermore, in certain embodiments, the direction of travel may be determined based on other information, such as the plan disclosed above with reference to FIG. 3. In such embodiments, the step of receiving the input signal indicative of the direction of travel may be omitted.

In response to determining the direction of travel is rearward, initial position(s) of the shoe(s) relative to the dozer blade assembly are stored, as represented by block 506. Next, as represented by block 508, actuator(s) are controlled to drive the shoe(s) to disengage the ground surface. As previously discussed, controlling the actuator(s) may include directly controlling electromechanical actuator(s) and/or controlling a valve assembly fluidly coupled to hydraulic actuator(s) and/or pneumatic actuator(s). In certain embodiments, controlling the actuator(s) to drive the shoe(s) to disengage the ground surface includes controlling the actuator(s) to drive the shoe(s) away from the ground surface at least until contact between the shoe(s) and the ground surface is terminated (e.g., as determined based on feedback from ground contact sensor(s)).

In certain embodiments, in response to determining the direction of travel is forward, the actuator(s) are controlled to drive the shoe(s) to engage the ground surface, as represented by block 510. For example, controlling the actuator(s) to drive the shoe(s) to engage the ground surface may include controlling the actuator(s) to drive the shoe(s) toward the ground surface at least until contact between the shoe(s) and the ground surface is established (e.g., as determined based on feedback from ground contact sensor(s)). Furthermore, in certain embodiments, in response to determining the direction of travel is forward, the actuator(s) are controlled to drive the shoe(s) to move to the initial position(s), as represented by block 512. In embodiments in which the shoe(s) are not driven to move to the initial position(s), the step of storing the initial position(s) in response to determining the direction of travel is rearward may be omitted.

While only certain features have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A shoe control system for a dozer blade assembly, comprising:

a controller comprising a processor and a memory, wherein the controller is configured to:

determine a direction of travel of the dozer blade assembly; and control an actuator to drive a shoe of the dozer blade assembly to disengage a ground surface in response to determining the direction of travel is rearward.

2. The shoe control system of claim 1, comprising a spatial locating device communicatively coupled to the controller and configured to output an input signal indicative of the direction of travel, wherein the controller is configured to receive the input signal and to determine the direction of travel based on the input signal.

3. The shoe control system of claim 1, comprising a hand controller communicatively coupled to the controller and configured to output an input signal indicative of the direction of travel, wherein the controller is configured to receive the input signal and to determine the direction of travel based on the input signal.

4. The shoe control system of claim 1, comprising a speed sensor communicatively coupled to the controller and configured to output an input signal indicative of the direction of travel, wherein the controller is configured to receive the input signal and to determine the direction of travel based on the input signal.

5. The shoe control system of claim 1, wherein the controller is configured to control the actuator to drive the shoe to engage the ground surface in response to determining the direction of travel is forward.

6. The shoe control system of claim 1, wherein the controller, in response to determining the direction of travel is rearward, is configured to store an initial position of the shoe relative to a dozer blade of the dozer blade assembly before controlling the actuator to drive the shoe to disengage the ground surface, and the controller is configured to control the actuator to drive the shoe to move to the initial position in response to determining the direction of travel is forward.

7. The shoe control system of claim 1, comprising a ground contact sensor communicatively coupled to the controller and configured to output a sensor signal indicative of contact between the shoe and the ground surface, wherein the controller, in response to determining the direction of travel is rearward, is configured to control the actuator to drive the shoe away from the ground surface at least until contact between the shoe and the ground surface is terminated.

8. The shoe control system of claim 7, wherein the controller, in response to determining the direction of travel is forward, is configured to control the actuator to drive the shoe toward the ground surface at least until contact between the shoe and the ground surface is established.

9. A shoe control system for a dozer blade assembly, comprising:

an actuator configured to couple to a shoe of the dozer blade assembly, wherein the actuator is configured to drive the shoe to move relative to a dozer blade of the dozer blade assembly; and a controller comprising a processor and a memory, wherein the controller is communicatively coupled to the actuator, and the controller is configured to:

determine a direction of travel of the dozer blade assembly; and control the actuator to drive the shoe to disengage a ground surface in response to determining the direction of travel is rearward.

10. The shoe control system of claim 9, wherein the actuator comprises an electromechanical actuator communicatively coupled to the controller.

11. The shoe control system of claim 9, comprising a valve assembly communicatively coupled to the controller, wherein the actuator comprises a hydraulic actuator fluidly coupled to the valve assembly.

12. The shoe control system of claim 9, wherein the controller is configured to control the actuator to drive the shoe to engage the ground surface in response to determining the direction of travel is forward.

13. The shoe control system of claim 9, wherein the controller, in response to determining the direction of travel is rearward, is configured to store an initial position of the shoe relative to the dozer blade before controlling the actuator to drive the shoe to disengage the ground surface, and the controller is configured to control the actuator to drive the shoe to move to the initial position in response to determining the direction of travel is forward.

14. The shoe control system of claim 9, comprising a ground contact sensor communicatively coupled to the controller and configured to output a sensor signal indicative of contact between the shoe and the ground surface, wherein the controller, in response to determining the direction of travel is rearward, is configured to control the actuator to drive the shoe away from the ground surface at least until contact between the shoe and the ground surface is terminated.

15. The shoe control system of claim 14, wherein the controller, in response to determining the direction of travel is forward, is configured to control the actuator to drive the shoe toward the ground surface at least until contact between the shoe and the ground surface is established.

16. A method for controlling a shoe of a dozer blade assembly, comprising:

determining, via a controller having a memory and a processor, a direction of travel of the dozer blade assembly; and controlling, via the controller, an actuator to drive the shoe to disengage a ground surface in response to determining the direction of travel is rearward.

17. The method of claim 16, comprising controlling, via the controller, the actuator to drive the shoe to engage the ground surface in response to determining the direction of travel is forward.

18. The method of claim 16, comprising:

storing, via the controller in response to determining the direction of travel is rearward, an initial position of the shoe relative to a dozer blade of the dozer blade assembly before controlling the actuator to drive the shoe to disengage the ground surface; and controlling, via the controller, the actuator to drive the shoe to move to the initial position in response to determining the direction of travel is forward.

19. The method of claim 16, comprising:

receiving, via the controller, an input signal indicative of the direction of travel; and determining, via the controller, the direction of travel based on the input signal.

20. The method of claim 16, wherein the actuator comprises a hydraulic actuator, and controlling the actuator comprises controlling a valve assembly fluidly coupled to the hydraulic actuator.

* * * * *